United States Patent [19]

Straitz, III et al.

[11] 4,065,248

[45] Dec. 27, 1977

[54] GROUND FLARE

[75] Inventors: John F. Straitz, III, Meadowbrook; Vicente A. Mendoza, Norristown, both of Pa.

[73] Assignee: National Airoil Burner Co., Inc., Philadelphia, Pa.

[21] Appl. No.: 647,362

[22] Filed: Jan. 8, 1976

[51] Int. Cl.[2] ..... F23D 13/24; F16L 1/02

[52] U.S. Cl. ..... 431/202; 138/105; 431/285

[58] Field of Search ..... 23/277 C; 431/5, 180, 431/170, 202, 179, 283, 285; 138/105

[56] References Cited

U.S. PATENT DOCUMENTS

| | | | |
|---|---|---|---|
| 1,317,495 | 9/1919 | Hessel | 138/105 |
| 2,625,992 | 1/1953 | Beck | 431/179 X |
| 3,322,178 | 5/1967 | Nahas | 431/202 X |
| 3,694,137 | 9/1972 | Fichter et al. | 431/60 X |
| 3,703,349 | 11/1972 | Straitz | 431/202 |
| 3,749,546 | 7/1973 | Reed et al. | 431/202 X |
| 3,822,983 | 7/1974 | Proctor et al. | 431/202 |
| 3,881,857 | 5/1975 | Hoy et al. | 431/170 X |
| 3,885,919 | 5/1975 | Pillard | 431/202 X |

*Primary Examiner*—Carlton R. Croyle
*Assistant Examiner*—Leonard E. Smith
*Attorney, Agent, or Firm*—Zachary T. Wobensmith, 2nd; Zachary T. Wobensmith, III

[57] ABSTRACT

A ground flare for burning of waste gas is disclosed having groups of burners in a pit for selective utilization in accordance with the quantity of gas to be burned together with controls therefor, and with provisions for reducing expansion of the headers carrying the gas. The burners are in groups, the burners in each succeeding group being in a predetermined increasing number to provide great variability in capacity of gas to be burned and with the burners being utilized more effectively than heretofore upon variation in the quantity of the waste gas delivered to be burned.

2 Claims, 10 Drawing Figures

FIG. 7
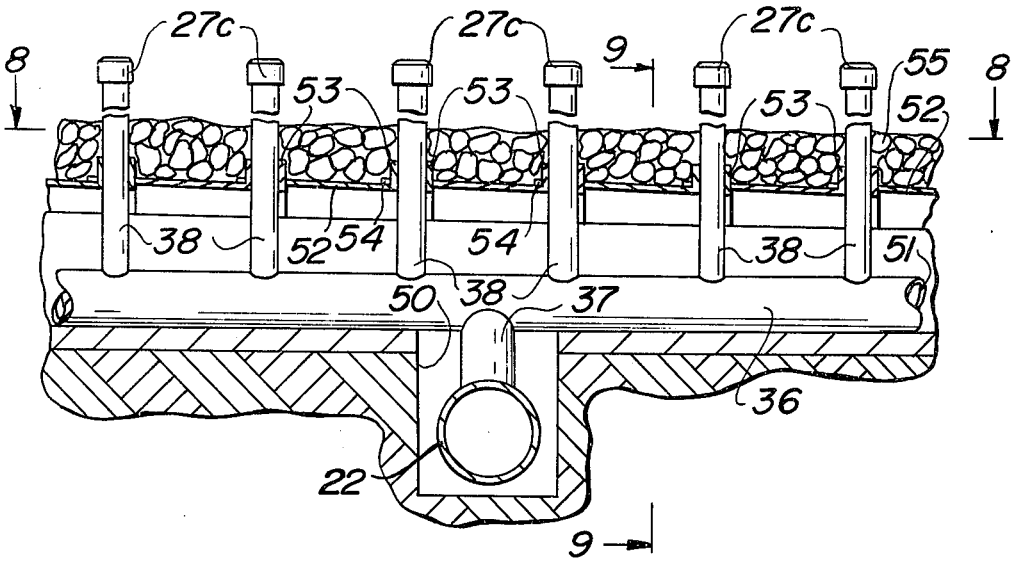
FIG. 8
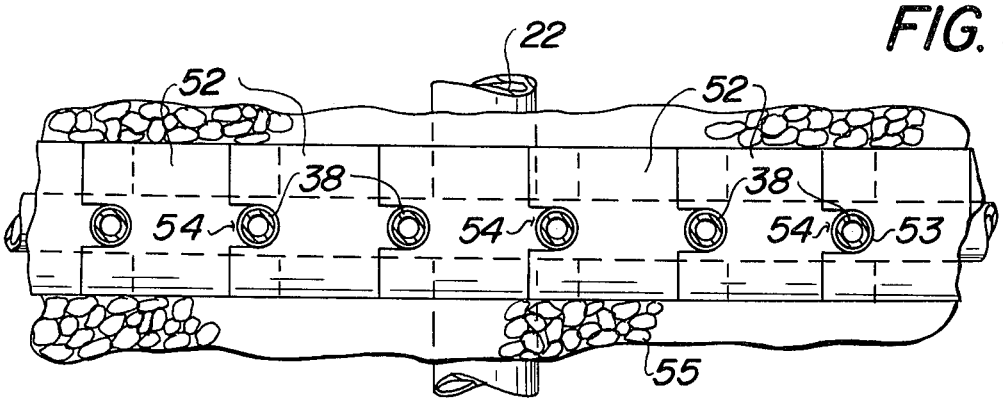
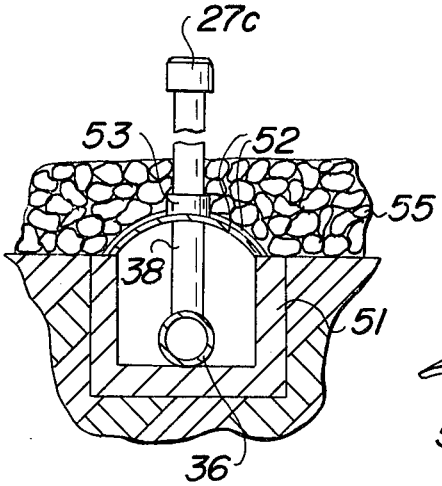
FIG. 9
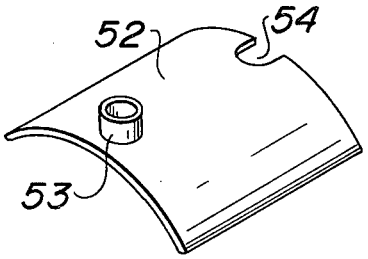
FIG. 10

GROUND FLARE

BACKGROUND OF THE INVENTION

1. Field of the Invention

This invention relates to ground flares for the combustion of waste gas from oil refineries and the like.

2. Description of the Prior Art

It has heretofore been proposed to burn combustible waste gases in ground flares in which the burners are disposed in a pit surrounded by embankments or enclosing walls. Reference may be had to the prior U.S. patent to J. F. Straitz, U.S. Pat. No. 3,703,349 and to Proctor, et al., U.S. Pat. No. 3,822,983, and Reed, et al., U.S. Pat. No. 3,749,546.

The ground flares heretofore available were limited as to their capacity, were not adapted to wide variations of quantity of gas to be burned, in some instances did not have the burners disposed for adequate air feed thereto for supporting combustion and in other instances had the headers exposed to the radiant heat of the combustion.

SUMMARY OF THE INVENTION

In accordance with the invention a ground flare is provided in a pit surrounded by an embankment or wall and having related groups of burners in numbers increasing in a predetermined ratio, and preferably in geometric progression, from one end to the other for accommodation of gas over a wide range of flow, the headers to which the burners are connected being shielded, and control apparatus being provided for effective utilization of the groups of burners.

It is the principal object of the invention to provide a ground flare for combustion of waste gas which is suited for a wide range of flow of the gas to be burned.

It is a further object of the invention to provide a ground flare in which the effects of expansion of the headers due to heat and cold is minimized.

It is a further object of the invention to provide a ground flare in which combustion of waste gas is accomplished in a more effective manner than heretofore.

Other objects of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 7 is a fragmentary vertical sectional view, enlarged, taken approximately on the line 7—7 of FIG. 6;

FIG. 8 is a fragmentary horizontal sectional view taken approximately on the line 8—8 of FIG. 7;

FIG. 9 is a fragmentary vertical sectional view taken approximately on the line 9—9 of FIG. 7; and FIG. 10 is a view in perspective of one of the shield plates employed in the form of the invention illustrated in FIGS. 6 to 9, inclusive.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF PREFERRED EMBODIMENTS

Figure 1:
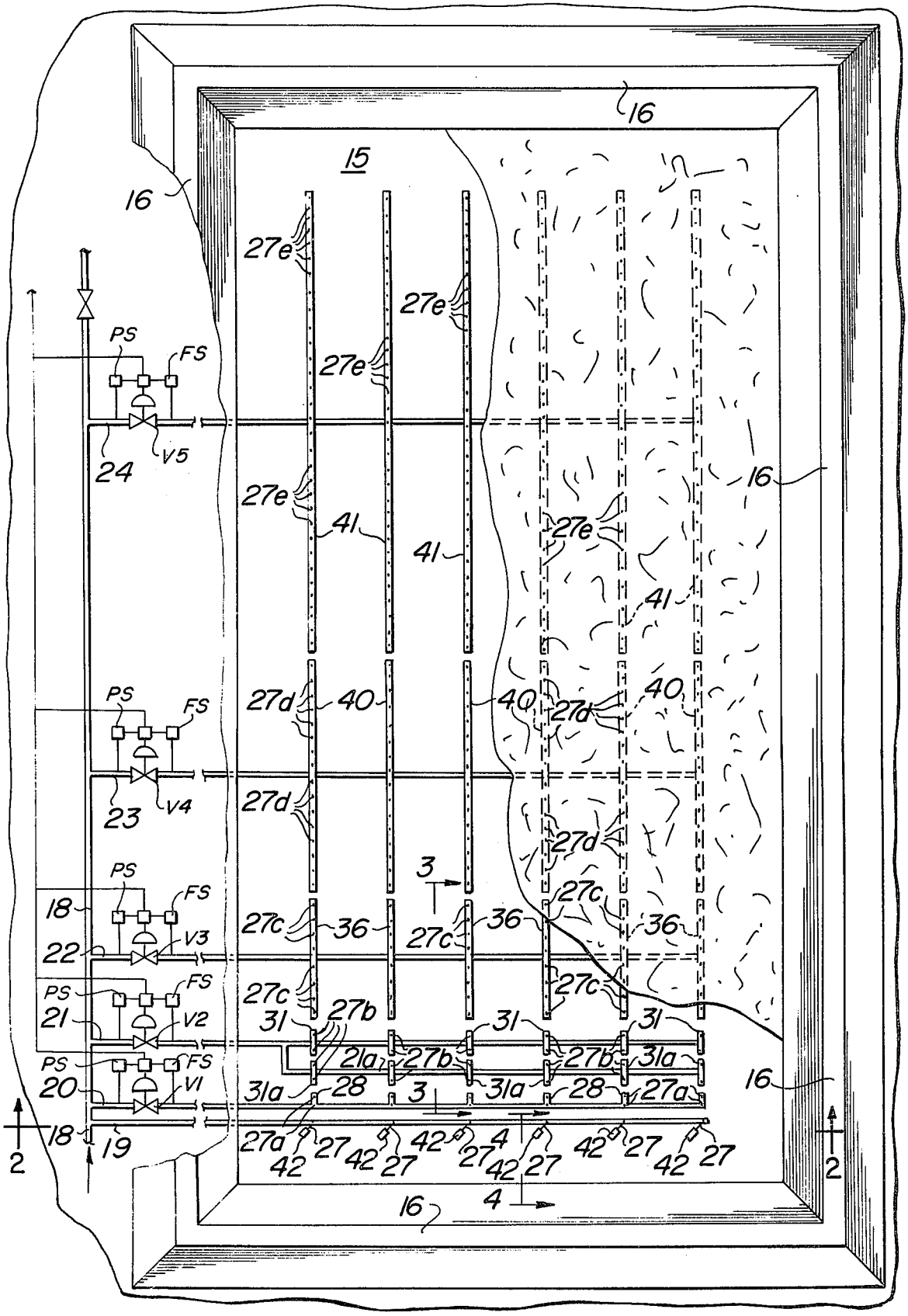
FIG. 1 is a top plan view of one embodiment of a ground flare in accordance with the invention, parts at the left of the pit being broken away to show the locations of the headers prior to covering.
Figure 2:
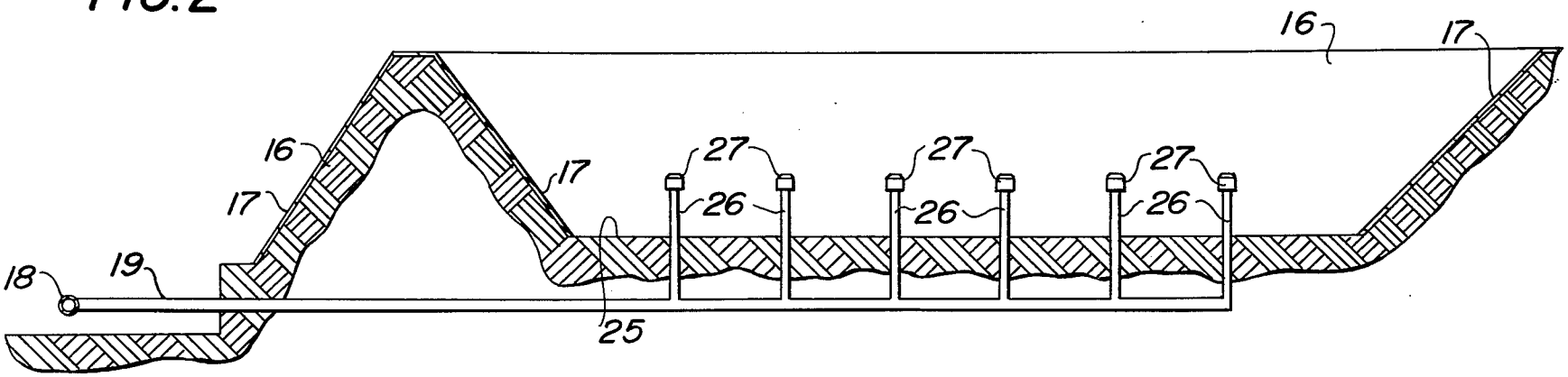
FIG. 2 is a vertical sectional view taken approximately on the line 2—2 of FIG. 1.
Figure 3:
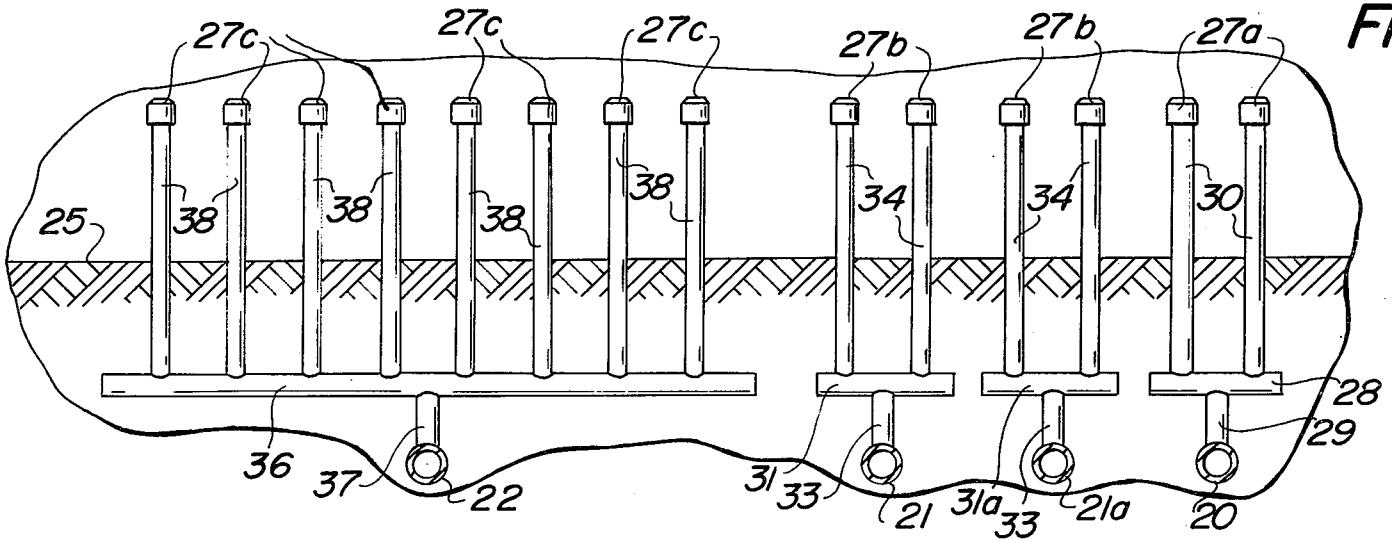
FIG. 3 is a fragmentary vertical sectional view taken approximately on the line 3—3 of FIG. 1.
Figure 5:
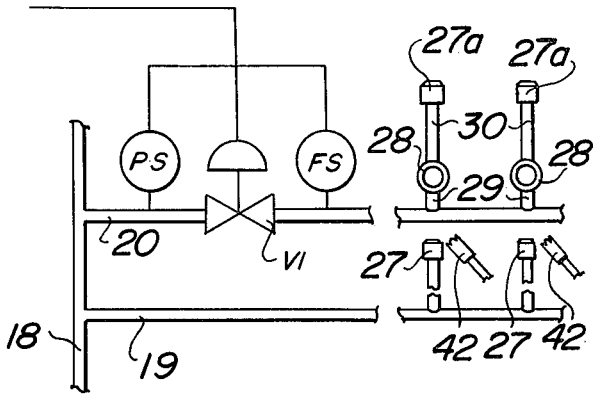
FIG. 5 is a fragmentary diagramatic view showing one of the controls.
Figure 4:
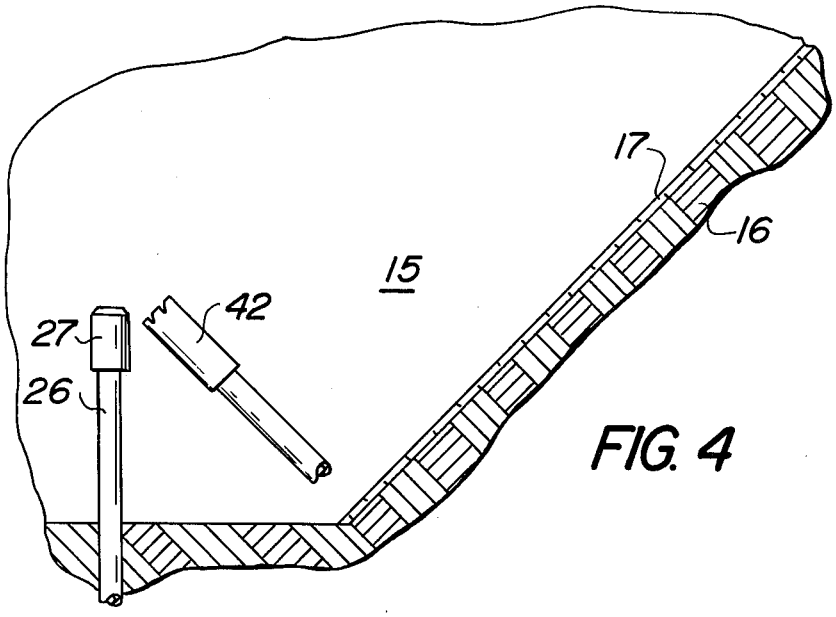
FIG. 4 is a fragmentary vertical sectional view taken approximately on the line 4—4 of FIG. 1.

Referring now more particularly to FIGS. 1 to 5, of the drawings, the ground flare there illustrated preferably includes a pit 15 with an earthen mound 16 therearound. The mound 16, on its exposed faces, can have a ceramic refractory facing 17 applied thereto to minimize erosion.

A waste gas supply pipe or main 18 is provided for delivery of the gas to be burned.

The main 18 has a plurality of horizontal headers or branch pipes 19, 20, 21, 22, 23 and 24 extending therefrom, beneath one of the bounding earthen walls 16 and transversely within the pit 15 and below the surface of the floor 25 of the pit 15. The floor 25, in one embodiment of the invention can be of coarse gravel of a thickness of about four inches.

The branch pipe 19 has connected thereto and extending vertically upwardly therefrom a plurality of spaced partially buried nozzle supply pipes 26 in a single row and carrying nozzles 27 on their upper ends.

The nozzles 27 can be of any suitable type but it has been found advantageous to employ nozzles as disclosed in Bitterlich, U.S. Pat. No. 3,463,602, and with which the gas is discharged through ports inclined with respect to the vertical longitudinal axis and at an angle to a horizontal radius through the burner head or nozzle.

The branch pipe 20 has a plurality of manifolds 28 connected thereto by pipes 29. Each manifold 28 has extending vertically upwardly therefrom a pair of spaced partially buried nozzle supply pipes 30 with nozzles **27*a*, similar to the nozzles 27, on their upper ends. The nozzles 27*a* in pairs are preferably in longitudinal rows corresponding to the locations of the nozzles 27**.

The branch pipe 21 has a further branch pipe **21*a* connected thereto and extending transversely and parallel with transversely spaced manifolds 31 and 31*a*, similar to the manifold 28 connected by pipes 33. The manifolds 31 and 31*a* have nozzle supply pipes 34 extending upwardly therefrom with nozzles 27*b*, similar to the nozzles 27 and 27*a*, on their upper ends. The nozzles 27*b*** are thus in groups of four longitudinally considered and are in transverse alignment as seen from above.

The branch pipe 22 has a plurality of transversely spaced manifolds 36, similar to the manifolds 28, 31 and **31*a*, connected thereto by pipes 37. The manifolds 36 have nozzle supply pipes 38 extending upwardly therefrom with nozzles 27*c*, similar to the nozzles 27, 27*a*, and 27*b*, on their upper ends. The nozzles 27*c*** are shown as in groups of eight, longitudinally considered and are in transverse alignment as seen from above.

The branch pipes 23 and 24 preferably have a plurality of manifolds 40 and 41 connected thereto, similar to the manifolds 28, 31, 31*a* and 36 but of greater length and with vertically upwardly extending nozzle supply pipes (not shown) similar to the nozzle supply pipes 26, 30, 34, and 38, for nozzles 27*d* in groups of sixteen, longitudinally considered, connected to the pipe 23 and for nozzles 27*e* in groups of thirty-two longitudinally considered, connected to the pipe 24.

The nozzles 27 preferably are each provided with a gas pilot 42 having an igniter (not shown), of any suitable type for insuring the presence of a pilot flame when gas is supplied through the pipe 18.

Any desired controls may be employed to insure that proper nozzle capacity is available with waste gas supplied thereto as determined by the quantity to be burned.

For this purpose each of the branch pipes 20, 21, 22, 23 and 24 can be provided with an air or solenoid operated normally closed valve V1 to V5, inclusive, the valves being respectively moved to open position at set gas pressure levels sensed by a pressure senser PS and as determined by the quantity of waste gas delivered for combustion and held in open position for a predetermined time interval after a closing signal determined by decreasing pressure at a flow senser FS.

Figure 6:
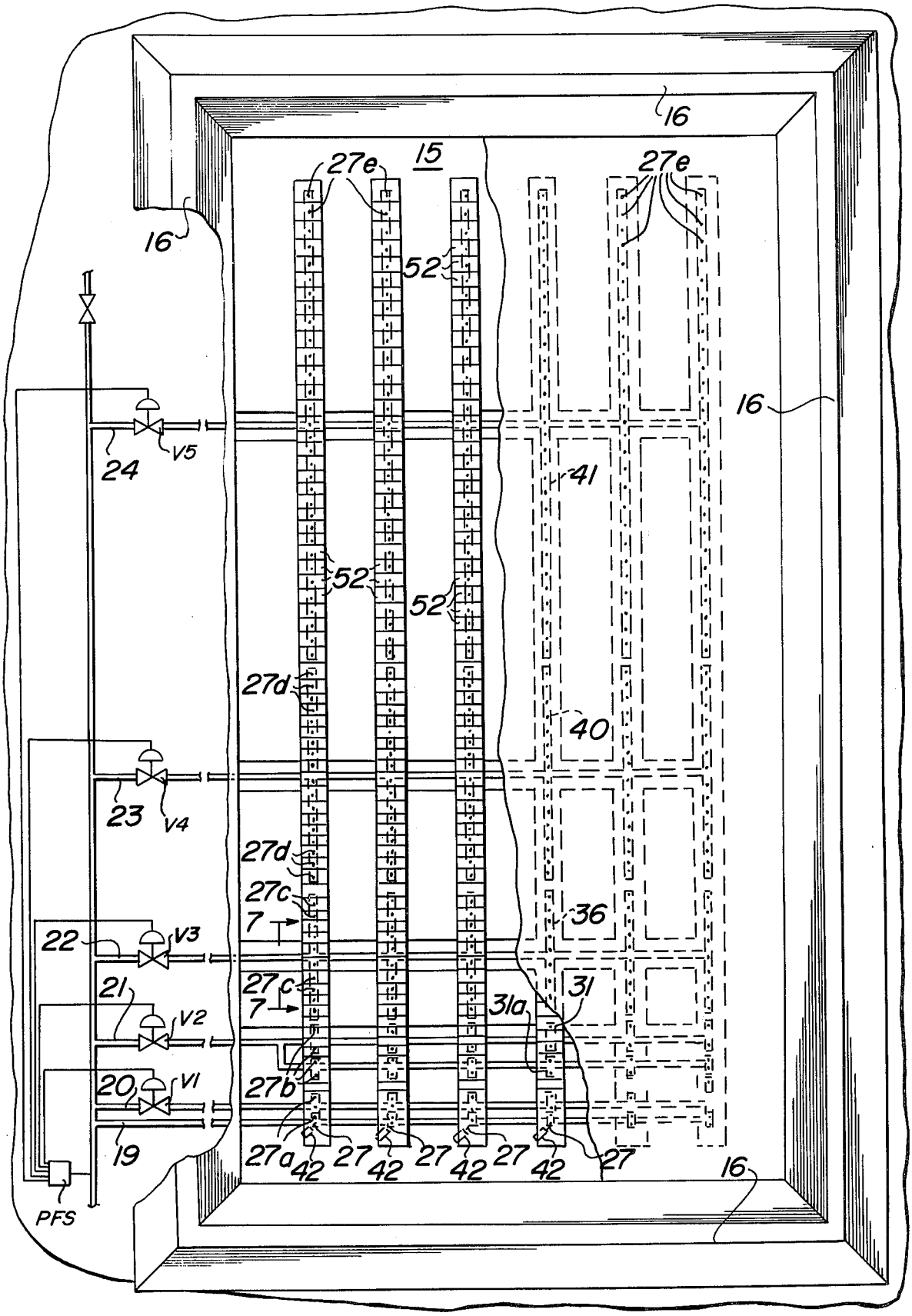
FIG. 6 is a top plan view of another embodiment of a ground flare in accordance with the invention, parts being broken away to show the locations of the headers.

Referring now more particularly to FIGS. 6 to 10 of the drawings, another embodiment of the invention is shown in which the supply main 18, headers 19 to 24, inclusive, with their manifolds, and nozzle supply pipes 26, 30, 34, and 38 and nozzles 27, 27*a*, 27*b*, 27 *c*, 27*d* and 27*e* are employed as before.

The branch pipes 19 to 24, inclusive, can be disposed in transverse trenches 50 with the manifolds 28, 31, 31*a*, 36, 40 and 41 in channels 51 of protective material such as heat resistant ceramic refractory or the like. The channels 51 are open at the top and are bridged at the top by cover plates 52 of metal or ceramic refractory material. The cover plates 52 are arcuate in transverse cross section as shown in FIGS. 9 and 10, preferably have an opening with a collar 53 near one end for passage therethrough of the nozzle supply pipes 26, 30, 34, 38 etc., and have a notch 54 at the other end for engagement by the collar 53 of the next cover plate 52. The plates 52 are disposed in an overlapping arrangement and are preferably covered by a coarse gravel layer 55 of a thickness of the order of two inches to provide a floating radiation shield.

Another form of control of the waste gas to the headers or branch pipes 20 to 24, inclusive, is disclosed in which these branch pipes are provided with air or solenoid operated normally closed valves V1 to V5, inclusive, as before with a pressure operated flow senser PFS providing signals at successive levels of waste gas flow to deliver the waste gas to the burners 27 to 27*e*, respectively, as required, and as hereinafter explained.

The mode of operation will now be pointed out.

Assume that a small quantity of combustible waste gas is supplied through the waste gas supply pipe or main 18 and to the branch pipe 19 for discharge through the nozzles 27 for combustion. The gas thus discharged is ignited by the pilots 42.

If the quantity of waste gas to be burned increases the increase is effective for delivery to the branch pipe 20 and the nozzles 27*a* connected thereto. The combustible gas delivered through the nozzles 27*a* is ignited by the gas burning at the contiguous nozzles 27.

Upon further increase in the quantity of waste gas this will be delivered as required through the nozzles 27*b*, 27*c*, 27*d* and/or 27*e* in accordance with the quantity available for combustion.

If at any time the quantity of gas available for combustion decreases then a successive reduction of the nozzles utilized will be effected by the control system described. The action is essentially a cascading action with a wide range of capacity based upon the geometrical series arrangement of the nozzles in groups.

The branch pipes 19 to 24, inclusive, the manifolds 31, 31*a*, 36, 40 and 41, and the upright nozzle supply pipes 26, 30, 34, 38 etc. are protected from extremes of heat and cold which may cause expansion problems while at the same time a wide range of combustible waste gas flow can be accommodated.

We claim:

1. A flare for use on the ground comprising wall members enclosing a space, a waste gas supply main, a plurality of horizontally disposed branch pipes extending from said waste gas supply main and within said space, a plurality of nozzle supporting pipes extending upwardly from said branch pipes and having gas burner nozzles carried thereby, each of said branch pipes having a predetermined number of gas burner nozzles connected thereto and supplied with waste gas therefrom for combustion, certain of said pipes being within preformed enclosures the top of which is covered by movable overlapped metal plates with notches through which said nozzle supporting pipes extend upwardly through said notches, said branch pipes and said nozzle supporting pipes being expansible and contractible free from restraint by said plates.

2. A flare as defined in claim 1 in which said cover plates have gravel thereover which comprises the floor of said space.

* * * * *